United States Patent [19]

Wedel

[11] Patent Number: 4,970,805

[45] Date of Patent: Nov. 20, 1990

[54] TRANSFER APPARATUS FOR TRANSFERRING A TAIL OF A WEB

[75] Inventor: Gregory L. Wedel, Beloit, Wis.

[73] Assignee: Beloit Corporation, Beloit, Wis.

[21] Appl. No.: 417,978

[22] Filed: Oct. 5, 1989

Related U.S. Application Data

[63] Continuation-in-part of Ser. No. 14,569, Feb. 13, 1987, Pat. No. 4,934,067.

[51] Int. Cl.[5] ..... F26B 11/02

[52] U.S. Cl. ..... 34/115; 34/116; 34/117

[58] Field of Search ..... 34/115, 116, 117

[56] References Cited

U.S. PATENT DOCUMENTS

| | | | |
|---|---|---|---|
| 4,000,035 | 12/1976 | Schiel et al. | 34/116 |
| 4,602,439 | 7/1986 | Eskelinen et al. | 34/116 |
| 4,625,434 | 12/1986 | Karlsson et al. | 34/116 |
| 4,669,198 | 6/1987 | Wedel | 34/116 |
| 4,693,784 | 9/1987 | Aula et al. | 34/115 |
| 4,716,660 | 1/1988 | Thiele | 34/116 |
| 4,875,976 | 10/1989 | Wedel | 34/117 |

*Primary Examiner*—Henry C. Yuen

*Attorney, Agent, or Firm*—Dirk J. Veneman; Raymond W. Campbell; David J. Archer

[57] ABSTRACT

A transfer apparatus is disclosed for transferring a tail of a web from a press roll to a dryer of a dryer section. The apparatus includes a lead-in roll which is disposed adjacent to and spaced relative to the press roll for leading the tail of the web from the press roll towards the dryer. A dryer felt extends around the lead-in roll and from the lead-in roll to the dryer such that the tail is supported by the felt from the lead-in roll to the dryer. The felt and the dryer define therebetween a positive air pressure in-going nip. A rotatable suction roll is disposed adjacent to and on the opposite side of the felt relative to the in-going nip such that in use of the apparatus, the suction roll generates a flow of air from the positive air pressure in-going nip through the felt such that when the tail of the web is being transferred from the press roll towards the dryer, the tendency for the positive air pressure in the vicinity of the in-going nip to prevent threading of the tail between the felt and the dryer is inhibited.

11 Claims, 3 Drawing Sheets

TRANSFER APPARATUS FOR TRANSFERRING A TAIL OF A WEB

CROSS-REFERENCE TO RELATED APPLICATION:

This application is a continuation-in-part of co-pending U.S. patent application Ser. No. 07/014,569 filed Feb. 13, 1987, now U.S. Pat. No. 4934067. All the subject matter of application Ser. No. 07/014,569 is incorporated herein by reference.

BACKGROUND OF THE INVENTION

Field of the Invention

The present invention relates to a transfer apparatus for transferring a tail of a web from a press roll to a dryer of a dryer section. More particularly, the present invention relates to a transfer apparatus in which a dryer felt extends around a lead-in roll disposed adjacent to and spaced relative to a press roll for leading a tail of the web from the press roll to a dryer.

INFORMATION DISCLOSURE STATEMENT

In the manufacture of a paper web, stock is ejected from a headbox onto a forming wire or between a pair of cooperating forming wires where water is removed from the stock in order to form a paper web.

The formed web is removed from the forming section by a pick-up roll and is guided through one or more press nips for removing more water from the web.

In a typical press section, the pressed web emerges from the last press nip as a sheet approximately 30 feet in width and traveling at 60 miles per hour.

The aforementioned pressed web must then be threaded into and through a dryer section for removing further moisture from the pressed web. Typically, in order to thread the pressed web into the dryer section, a narrow tail, approximately 6 inches wide, is cut from the pressed web and the entire width of the web is doctored from the press roll to a broke pit. The narrow tail is then directed by an air wand around a guide roll and into a converging nip defined between a dryer felt and a baby dryer drum of the dryer section. Consequently, considerable skill is required by an operator in effectively handling the tail and directing the tail into the converging nip of the dryer section, which is running at a slightly higher speed than the press section in order to take up any slack in the threaded tail.

When the tail of the web has been threaded, the tail is widened to the full width of the web so that the full width of the pressed web is threaded into and through the dryer section.

In the prior art arrangements, not only is it difficult for an operator to thread the tail into the dryer section but air flows in the vicinity of the transfer apparatus between the press section and the dryer section tends to increase the problems associated with threading the tail into the dryer section.

Accordingly, many dryer sections have a dryer felt which extends into close proximity with the press roll such that the dryer felt extends around a lead-in roll disposed adjacent to and spaced relative to the press roll. The arrangement is such that an operator merely guides the tail from the press roll to the underside of the dryer felt so that the tail supported beneath the dryer felt is guided into the converging nip between the dryer felt and the baby dryer.

Even though such an arrangement facilitated the threading operation, problems have been experienced in the prior art arrangements in that the tail of the web tends to detach from the underside of the felt between the lead-in roll and the baby dryer.

Therefore, transfer apparatus have been proposed, which include blow boxes or vacuum boxes disposed on the opposite side of the felt relative to the tail of the web, for drawing the tail into close conformity with the felt. Although such arrangements avoid the problem of the tail detaching from the felt, such arrangements have added a further problem in that when the necessary vacuum level is applied on the opposite side of the felt, the felt is drawn into frictional contact with the blow box or vacuum box, thereby causing felt wear and premature failure of the dryer felt.

A vacuum transfer box of the aforementioned type is disclosed in U.S. Pat. No. 3,526,574 to Amend. A blow box type arrangement is disclosed in U.S. Pat. No. 4,551,203 to Eskelinen.

According to the present invention, it has unexpectedly been discovered that the real problem of tail detachment resides in the build-up of a positive air pressure at the in-going, or converging, nip defined between the dryer felt and the baby dryer. Moreover, it has been discovered that in the absence of such an over-pressure there exists no need to draw the tail of the web into close conformity with the dryer felt and that the relatively moist tail of the web will readily adhere to the dryer felt between the lead-in roll and the dryer section. However, during the threading operation, as the tail of the web approaches the converging nip of the prior art arrangement, the increased air pressure at the converging nip tends to blow the leading edge of the tail away from the converging nip. Furthermore, an air pocket is generated between the tail of the web and the felt and such air pocket moves from the leading edge of the tail and progresses back towards the lead-in roll, thereby causing detachment of the tail of the web from the felt.

The present invention overcomes the aforementioned problem by applying a relatively high vacuum adjacent to the positive air pressure converging nip but on the opposite side of the felt relative to the nip for drawing air from the converging nip through the dryer felt so that the leading edge of the tail of the web may be readily threaded between the dryer felt and the baby dryer.

Therefore, it is a primary object of the present invention to provide a transfer apparatus that overcomes the aforementioned problems associated with the prior art arrangements and that makes a considerable contribution to the art of transferring a tail of a web from a press roll to a dryer of a dryer section.

Another object of the present invention is the provision of a transfer apparatus in which a dryer felt and the dryer define therebetween a positive air pressure in-going nip. A rotatable suction roll is disposed adjacent to and on the opposite side of the felt relative to the in-going nip such that in use of the apparatus, the suction roll generates a flow of air from the positive air pressure in-going nip through the felt. The arrangement is such that when the tail of the web is being transferred from the press roll towards the dryer, the tendency for the positive air pressure in the vicinity of the in-going nip to prevent threading of the tail between the felt and the dryer is inhibited.

Another object of the present invention is the provision of a suction roll which is disposed at a distance within 1 to 2 inches from the dryer so that a positive pressure at the in-going nip is inhibited.

Another object of the present invention is the provision of a transfer apparatus which includes a suction roll having a rotatable perforate shell and a center shaft which defines a sector-shaped suction zone which is disposed adjacent to and on the opposite side of the felt relative to the in-going nip.

Another object of the present invention is the provision of a transfer apparatus in which the felt wraps around the perforate shell such that the sector-shaped zone extends towards the dryer a distance within the range 1 to 2 inches from a point at which the felt diverges relative to the suction roll for drawing air through the felt from the in-going nip while maintaining a space between the perforate shell and the dryer to accommodate passage of a wad of paper therethrough in the event of the web wrapping the dryer.

Another object of the present invention is the provision of a transfer apparatus in which the sector-shaped zone extends away from the dryer a distance within the range 1 to 2 inches from a point at which the felt converges with the perforate shell.

Another object of the present invention is the provision of a vacuum of at least 4 inches water column (WC) within the sector-shaped suction zone for drawing away the positive air pressure within the converging nip.

Another object of the present invention is the provision of a transfer apparatus which includes a deflector shield extending between the lead-in roll and the suction roll for inhibiting the build-up of a positive air pressure in the vicinity of a further in-going nip between the felt and the suction roll and for augmenting the flow of air through the felt from the in-going nip towards the suction roll.

Other objects and advantages of the present invention will be readily apparent to those skilled in the art by a consideration of the detailed description contained hereinafter taken in conjunction with the annexed drawings.

SUMMARY OF THE INVENTION

The present invention relates to a transfer apparatus and method for transferring a tail of a web from a press roll to a dryer of a dryer section. The apparatus includes a lead-in roll which is disposed adjacent to and spaced relative to the press roll for leading the web from the press roll towards the dryer.

A dryer felt extends around the lead-in roll and from the lead-in roll to the dryer such that the web is supported by the felt from the lead-in roll to the dryer. The felt and the dryer define therebetween a positive air pressure in-going nip.

A rotatable suction roll is disposed adjacent to and on the opposite side of the felt relative to the in-going nip such that in use of the apparatus, the suction roll generates a flow of air from the positive air pressure in-going nip through the felt. The arrangement is such that when the tail of the web is being transferred from the press roll towards the dryer, the tendency for the positive air pressure in the vicinity of the in-going nip to prevent threading of the tail between the felt and the dryer is inhibited.

In a more specific embodiment of the present invention, the dryer felt is disposed between the tail of the web and the lead-in roll.

Furthermore, the suction roll is disposed less than 4 inches from the dryer and preferable at a distance within the range 1 to 2 inches from the dryer.

The suction roll further includes a rotatable perforate shell and a stationary hollow center shaft which is connected to a source of partial vacuum. The center shaft defines a sector-shaped suction zone which is disposed adjacent to and on the opposite side of the felt relative to the in-going nip such that the flow of air flows from the positive air pressure in-going nip through the felt into the suction zone.

The felt wraps around the perforate shell such that the sector-shaped zone extends towards the dryer a distance that is within the range 1 to 2 inches from a point at which the felt diverges relative to the suction roll. The arrangement is such that air is drawn through the felt from the in-going nip while maintaining a space between the perforate shell and the dryer to accommodate the passage of a wad of paper therethrough in the event of the web wrapping the dryer.

The sector-shaped zone also extends away from the dryer a distance within the range 1 to 2 inches from a point at which the felt converges with the perforate shell.

The sector-shaped zone maintains a partial vacuum of at least 4 inches WC.

In an alternative embodiment of the present invention, the transfer apparatus also includes a deflector shield which extends between the lead-in roll and the suction roll. The felt is disposed between the tail of the web and the shield, and the shield diverges relative to the felt in a direction from the lead-in roll towards the suction roll for augmenting the flow of air, thereby urging the tail of the web into close conformity with the felt. Such deflector shield also inhibits the build-up of a further positive air pressure at the in-going nip defined between the felt and the suction roll.

The present invention also includes a method of transferring a tail of a web from a press roll to a dryer of a dryer section. The method includes the steps of:

leading a tail of the web from the press roll around a lead-in roll such that the tail of the web is supported by a felt extending around the lead-in roll and from the lead-in roll to the dryer of the dryer section; and drawing air from a positive pressure in-going nip defined between the felt and the dryer such that the flow of air flows from the in-going nip through the felt towards a rotatable suction roll disposed adjacent to the in-going nip but on the opposite side of the felt relative to the in-going nip such that any tendency for the positive air pressure in the vicinity of the in-going nip to prevent threading of the tail between the felt and the dryer is inhibited.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims. Included in such modifications would be the provision of a suction sector within the baby dryer for reducing the positive air pressure within the in-going nip.

BRIEF DESCRIPTION OF THE DRAWINGS

Similar reference characters refer to similar parts throughout the various embodiments of the present invention.

DETAILED DESCRIPTION OF THE DRAWINGS

Figure 1:
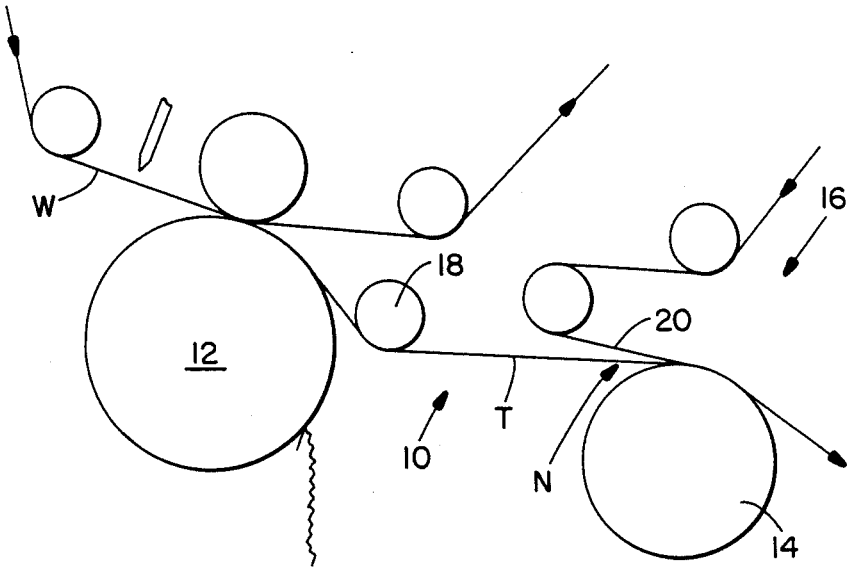
FIG. 1 PRIOR ART
FIG. 1 is a side-elevational view of a prior art transfer apparatus for transferring a tail of a web from a press roll to a dryer of a dryer section.

FIG. 1 is a side-elevational view of a typical prior art transfer apparatus generally designated 10 for transferring unsupported tail T of a web W from a press roll 12 to a baby dryer 14 of a dryer section generally designated 16. The apparatus 10 includes a guide roll 18 for guiding the tail T from the press roll 12 to a converging nip N defined between a dryer felt 20 and the baby dryer 14 of the dryer section 16. As will be appreciated by those skilled in the art, the threading of the tail T of the web W from the press roll 12 into the converging nip N requires considerable skill on the part of an operator.

Figure 2:
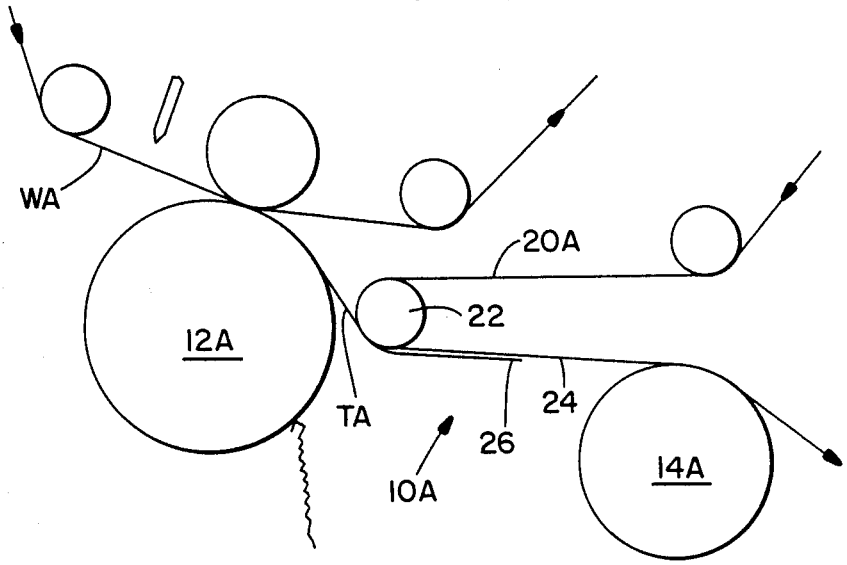
FIG. 2 PRIOR ART
FIG. 2 is a side-elevational view of another prior art transfer apparatus in which the dryer felt is disposed in close proximity to the press roll and extends around a lead-in roll.

FIG. 2 is a side-elevational view of another prior art transfer apparatus generally designated 10A for leading a tail TA of a web WA from a press roll 12A to a dryer 14A. The apparatus 10A includes a dryer felt 20A which is led into close proximity with the press roll 12A. The dryer felt 20A is guided around a lead-in roll 22 disposed adjacent to and spaced relative to the press roll 12A. However, there exists a tendency for the tail TA to detach from the underside 24 of the felt 20A prior to the leading edge 26 of the tail TA extending between the dryer felt 20A and the dryer 14A.

Figure 3:
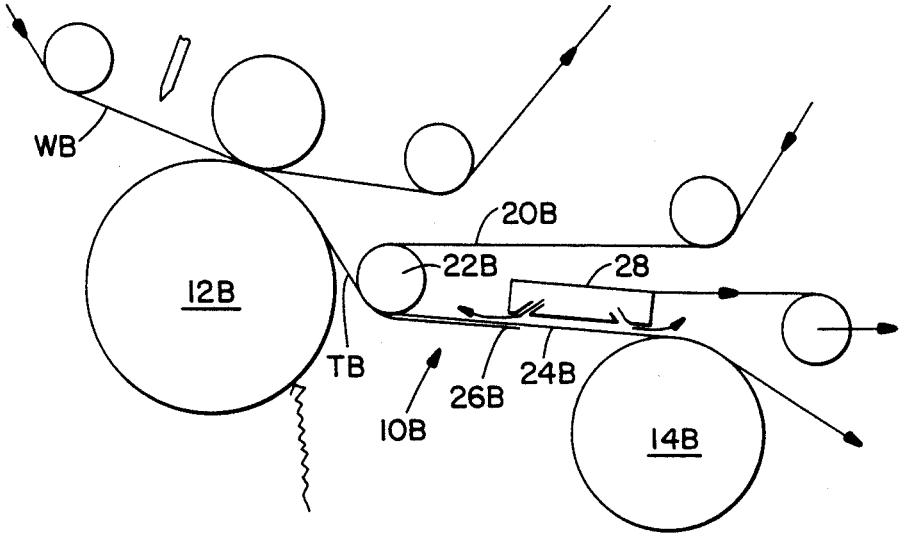
FIG. 3 PRIOR ART
FIG. 3 is a side-elevational view of another prior art transfer apparatus in which a blow box draws a tail towards the dryer felt.

FIG. 3 is a side-elevational view of another prior art arrangement as exemplified in U.S. Pat. No. 4,551,203 to Eskelinen and shows the provision of a blow box 28. A felt 20B is disposed between the box 28 and a tail TB. The box draws the tail TB of the web WB into close conformity with the dryer felt 20B. Such an arrangement, however, introduces a drawback in that in order to hold the tail of the web against the felt 20B, the required vacuum level is such that the felt 20B is drawn into frictional contact with the edges of the blow box 28, thereby causing scuffing and premature wear of the dryer felt 20B.

Figure 4:
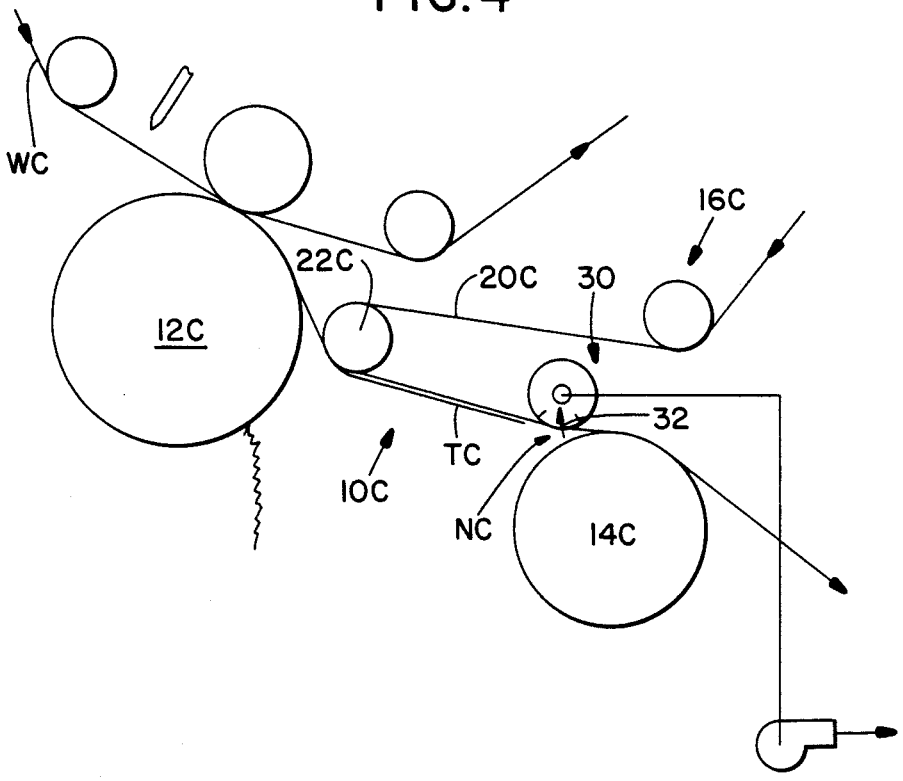
FIG. 4 is a side-elevational view of a transfer apparatus according to the present invention for transferring a tail of a web from a press roll to a dryer of a dryer section.

FIG. 4 is a side-elevational view of a transfer apparatus generally designated 10C according to the present invention for transferring a tail TC of a web WC from a press roll 12C to a dryer 14C of a dryer section generally designated 16C. The apparatus 10C includes a lead-in roll 22C which is disposed adjacent to and spaced relative to the press roll 12C for leading the tail TC of the web WC from the press roll 12C towards the dryer 14C.

A dryer felt 20C extends around the lead-in roll 22C and from the lead-in roll 22C to the dryer 14C such that the tail TC of the web WC is supported by the felt 20C from the lead-in roll 22C to the dryer 14C. The felt 20C and the dryer 14C define therebetween a positive air pressure in-going nip NC.

A rotatable suction roll generally designated 30 is disposed adjacent to and on the opposite side of the felt 20C relative to the in-going nip NC such that in use of the apparatus 10C, the suction roll 30 generates a flow of air as indicated by the arrow 32 from the positive air pressure in-going nip NC through the felt 20C such that when the tail TC of the web WC is being transferred from the press roll 12C towards the dryer 14C, the tendency of the positive air pressure in the vicinity of the in-going nip NC to prevent threading of the tail TC between the felt 20C and the dryer 14C is inhibited.

As shown in FIG. 4, the dryer felt 20C is disposed between the tail TC of the web WC and the lead-in roll 22C.

The suction roll 30 is disposed less than 4 inches from the dryer 14C, and in a preferred embodiment of the present invention, as shown in FIG. 4, the suction roll 30 is disposed at a distance within the range 1 to 2 inches from the dryer 14C.

Figure 5:
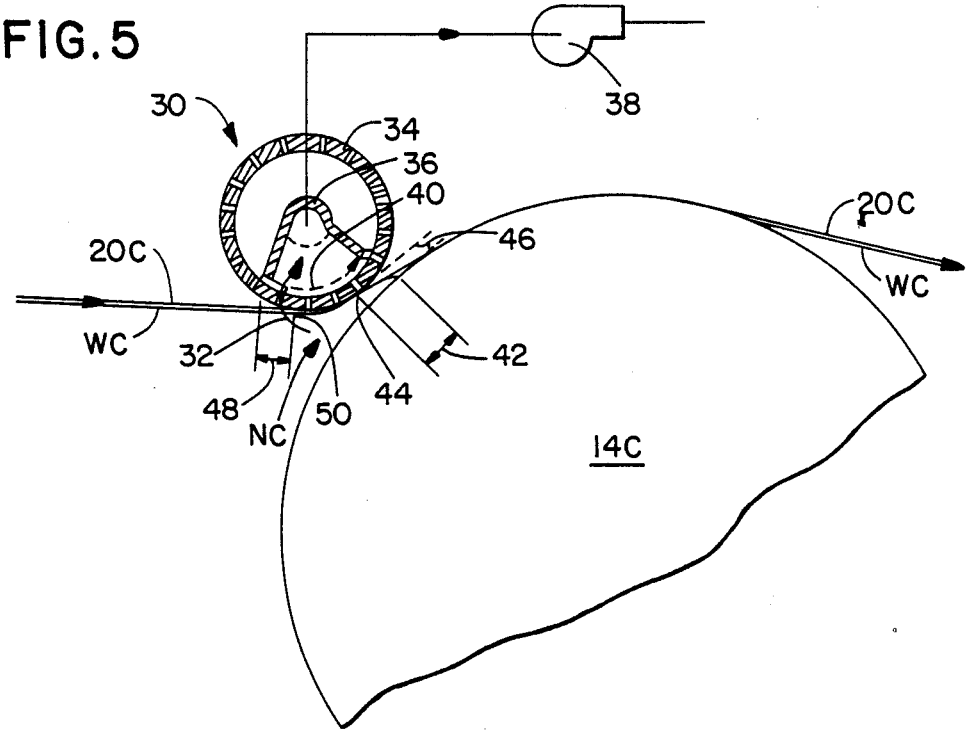
FIG. 5 is an enlarged side-elevational view of the rotatable suction roll and dryer shown in FIG. 4.

FIG. 5 is an enlarged view of the suction roll generally designated 30 and shows the suction roll 30 as including a rotatable perforate shell 34. A stationary hollow shaft 36 is disposed within the shell 34 and is connected to a source of partial vacuum 38. The shaft 36 defines a sector-shaped suction zone 40 which is disposed adjacent to and on the opposite side of the felt 20C relative to the in-going nip NC such that the flow of air 32 flows from the positive air pressure in-going nip NC through the felt 20C into the suction zone 40.

FIG. 5 shows the felt 20C as wrapping around the perforate shell 34 such that the sector-shaped zone 40 extends towards the dryer 14C a distance 42 within the range 1 to 2 inches from a point 44 at which the felt 20C diverges relative to the suction roll 30. The arrangement permits drawing air 32 through the felt 20C from the in-going nip NC while maintaining a space indicated by the arrow 46 between the perforate shell 34 and the dryer 14C to accommodate passage of a wad of paper in the event of the web WC breaking and wrapping around the dryer 14C.

As shown in FIG. 5, the sector-shaped zone 40 extends away from the dryer 14C a distance as indicated by the arrow 48 within the range 1 to 2 inches from a point 50 at which the felt 20C converges with the perforate shell 34.

The sector-shaped suction zone 40 maintains a partial vacuum of at least 4 inches water column (WC).

Figure 6:
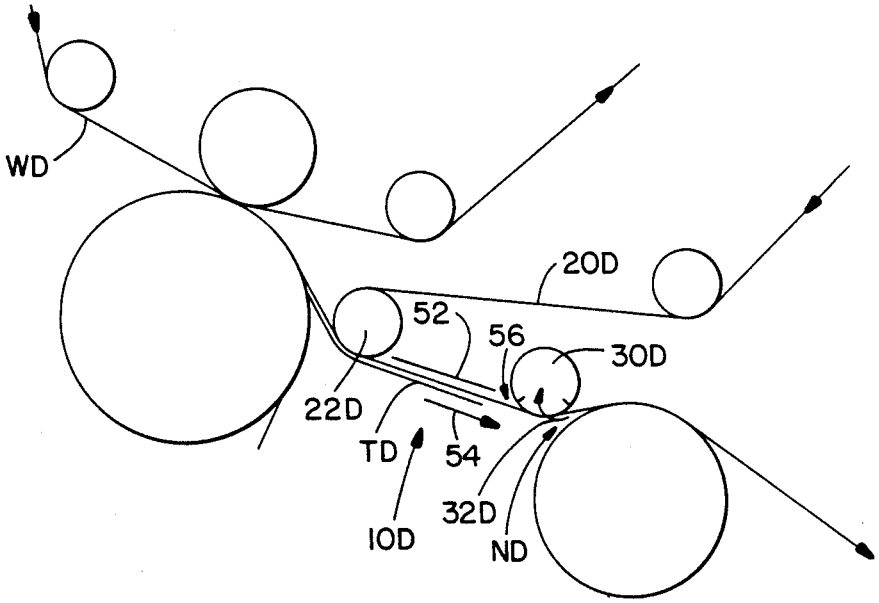
FIG. 6 is a side-elevational view of a further embodiment of the present invention including a deflector shield.

FIG. 6 is a side-elevational view of a further embodiment of the present invention and shows a transfer apparatus generally designated 10D. The apparatus 10D includes a deflector shield 52 which extends between a lead-in roll 22D and a suction roll 30D. A felt 20D is disposed between a tail TD of the web WD and the shield 52. The shield 52 diverges relative to the felt 20D in a direction as indicated by the arrow 54 from the lead-in roll 22D towards the suction roll 30D. Such divergence of the shield 52 generates a flow of air which augments the flow of air as indicated by the arrow 32D which flows from the in-going nip ND towards the suction roll 30D for urging the tail TD of the web WD into close conformity with the felt 20D. The generated air flow also inhibits the build-up of a positive air pressure within a further in-going nip 56 defined between the felt 20D and the suction roll 30D.

In operation of the transfer apparatus, as shown in FIGS. 4 and 5, the tail TC is supported by and beneath the dryer felt 20C. The positive air pressure generated within the in-going nip NC due to the pumping effect between the felt 20C and the dryer 14C is reduced by the suction roll 30 which draws a flow of air 32 from the in-going nip NC through the felt 20C towards the suction roll 30.

The perforate shell 34 of the suction roll 30 cooperates with the felt 20C, as shown in FIG. 5, so that the suction roll 30 is disposed at a distance 46 from the dryer 14C. The distance 46 is relatively small so that the suction within the zone 40 effectively reduces the air pressure within the in-going nip NC. However, in the event of the threaded web WC breaking and becoming enwrapped around the dryer 14C, the distance 46 permits several layers of the web WC to be enwrapped in order to allow time for stopping the rotation of the dryer 14C so that damage to the dryer 14C and the suction roll 30 is prevented.

In the embodiment shown in FIG. 6, the shield 52 diverges relative to the dryer felt 20D so that a partial vacuum is generated between the shield 52 and the dryer felt 20D. Such partial vacuum augments the flow of air 32D from the positive pressure nip ND and also assists in urging the tail TD into conformity with the dryer felt 20D. Additionally, the shield 52 prevents the build-up of a positive air pressure within a further nip 56 defined between the suction roll 30D and the dryer felt 20D which could otherwise tend to cause detachment of the tail TD from the felt 20D.

The present invention provides a transfer apparatus which facilitates threading of a tail of a web into a dryer section and inhibits frictional wear of the dryer felt.

What is claimed is:

1. A transfer apparatus for transferring a tail of a web from a pres roll to a dryer of a dryer section, said apparatus comprising:

a lead-ion roll disposed adjacent to and spaced relative to the press roll for leading the tail of the web from the press roll towards the dryer;

a dryer felt extending around said lead-in roll and from said lead-in roll to the dryer such that the tail of the web is supported by said felt from said lead-in roll to the dryer, said felt being disposed between the tail and said lead-in roll, said felt and the dryer defining therebetween a positive air pressure in-going nip; and a rotatable suction roll disposed adjacent to and on the opposite side of said felt relative to said in-going nip such that in use of said apparatus, said suction roll generates a flow of air from said positive air pressure in-going nip through said felt such that when the tail of the web is being transferred from the press roll towards the dryer, the tendency for said positive air pressure in the vicinity of said in-going nip to prevent threading of said tail between said felt and the dryer is inhibited.

2. A transfer apparatus as set forth in claim 1 wherein said dryer felt is disposed between the tail of the web and said lead-in roll.

3. A transfer apparatus as set forth in claim 1 wherein said suction roll is disposed less than 4 inches from the dryer.

4. A transfer apparatus as set forth in claim 1 wherein said suction roll is disposed at a distance within the range 1 to 2 inches from the dryer.

5. A transfer apparatus as set forth in claim 1 wherein said suction roll further includes:

a rotatable perforate shell;

a stationary hollow center shaft disposed within said shell and connected to a source of partial vacuum;

said center shaft defining a sector-shaped suction zone disposed adjacent to and on the opposite side of said felt relative to said in-going nip such that said flow of air flows from said positive air pressure in-going nip through said felt into said suction zone.

6. A transfer apparatus for transferring a tail of a web from a press roll to a dryer of a dryer section, said apparatus comprising:

a lead-in roll disposed adjacent to and spaced relative to the press roll for leading the tail of the web from the press roll towards the dryer;

a dryer felt extending around said lead-in roll and from said lead-in roll to the dryer such that the tail of the web is supported by said felt from said lead-in roll to the dryer, said felt and the dryer defining therebetween a positive air pressure in-going nip;

a rotatable suction roll disposed adjacent to and on the opposite side of said felt relative to said in-going nip such that in use of said apparatus, said suction roll generates a flow of air from said positive air pressure in-going nip through said felt such that when the tail of the web is being transferred from the press roll towards the dryer, the tendency for said positive air pressure in the vicinity of said in-going nip to prevent threading of said tail between said felt and the dryer is inhibited;

said suction roll further including: a rotatable perforate shell; a stationary hollow center shaft disposed within said shell and connected to a source of partial vacuum;

said center shaft defining a sector-shaped suction zone disposed adjacent to and on the opposite side of said felt relative to said in-going nip such that said flow of air flows from said positive air pressure in-going nip through said felt into said suction zone;

and said felt wrapping around said perforate shell such that said sector-shaped zone extends towards the dryer, a distance within the range 1 to 2 inches from a point at which said felt diverges relative to said suction roll for drawing air through said felt from said in-going nip while maintaining a space between said perforate shell and the dryer to accommodate passage of a wad of paper therethrough in the event of the web wrapping the dryer.

7. A transfer apparatus as set forth in claim 5 wherein said sector-shaped zone extends away from the dryer a distance within the range 1 to 2 inches from a point at which said felt converges with said perforate shell.

8. A transfer apparatus as set forth in claim 5 wherein said sector-shaped suction zone maintains a partial vacuum of at least 4 inches WC.

9. A transfer apparatus for transferring a tail of a web from a press roll to a dryer of a dryer section, said apparatus comprising:

A lead-in roll disposed adjacent to and spaced relative to the press roll for leading the tail of the web from the press roll towards the dryer;

a dryer felt extending around said lead-in roll and from said lead-in roll to the dryer such that the tail of the web is supported by said felt from said lead-in roll to the dryer, said felt and the dryer defining therebetween a positive air pressure in-going nip;

a rotatable suction roll disposed adjacent to and on the opposite side of said felt relative to said in-going nip such that in use of said apparatus, said suction roll generates a flow of air from said positive air pressure in-going nip through said felt such that when the tail of the web is being transferred from the press roll towards the dryer, the tendency for said positive air pressure in the vicinity of said in-going nip to prevent threading of said tail between said felt and the dryer is inhibited; and a deflector shield extending between said lead-in roll and said suction roll, said felt being disposed between the tail of the web and said shield, said shield diverging relative to said felt in a direction from said lead-in roll towards said suction roll for augmenting said flow of air for urging the tail of the web into close cconformity with said felt and for inhibiting the build-up of a positive air pressure further in-going nip defined between said felt and said suction roll.

10. A transfer apparatus for transferring a tail of a web from a press roll to a dryer of a dryer section, said apparatus comprising:

a lead-in roll disposed adjacent to and spaced relative to the press roll for leading the tail of the web from the press roll towards the dryer;

a dryer felt extending around said lead-in roll and from said lead-in roll to the dryer such that the tail of the web is supported by said felt from said lead-in roll to the dryer, said felt and the dryer defining therebetween a positive air pressure in-going nip;

a rotatable suction roll disposed adjacent to and on the opposite side of said felt relative to said in-going nip such that in use of said apparatus, said suction roll generates a flow of air from said positive air pressure in-going nip through said felt such that when the tail of the web is being transferred from the press roll towards the dryer, the tendency for said positive air pressure in the vicinity of said in-going nip to prevent threading of said tail between said felt and the dryer is inhibited;

said suction roll being disposed at a distance within the range 1 to 2 inches from the dryer;

said suction roll further including: a rotatable perforate shell;

a stationary hollow center shaft disposed within said shell and connected to a source of partial vacuum; and said center shaft defining a sector-shaped suction zone disposed adjacent to and on the opposite side of said felt relative to said in-going nip such that said flow of air flows from said positive air pressure in-going nip through said felt into said suction zone.

11. A method of transferring a tail of a web from a press roll to a dryer of a dryer section, said method comprising the steps of:

leading a tail of the web from the press roll around a lead-in roll such that the tail of the web is supported by a felt extending around the lead-in roll and from the lead-in roll to the dryer of the dryer section, the felt being disposed between the tail and the lead-in roll; and drawing air from a positive pressure in-going nip defined between the felt and the dryer such that the flow of air flows from the in-going nip through the felt towards a rotatable suction roll disposed adjacent to the in-going nip but on the opposite side of the felt relative to the in-going nip such that any tendency for the positive air pressure in the vicinity of the in-going nip to prevent threading of the tail between the felt and the dryer is inhibited.

* * * * *

UNITED STATES PATENT AND TRADEMARK OFFICE

CERTIFICATE OF CORRECTION

PATENT NO. : 4,970,805

DATED : November 20, 1990

INVENTOR(S) : Gregory L. Wedel

It is certified that error appears in the above—identified patent and that said Letters Patent is hereby corrected as shown below:

Column 9, Line 19: Please delete "cconformity" and insert therefor ---conformity---.

Signed and Sealed this

Third Day of March, 1992

*Attest:*

HARRY F. MANBECK, JR.

*Attesting Officer*

*Commissioner of Patents and Trademarks*